United States Patent [19]

Balk

[11] Patent Number: 4,797,079

[45] Date of Patent: Jan. 10, 1989

[54] APPARATUS FOR MAKING A THERMOPLASTIC MONOFILAMENT OF EXACT THICKNESS

[75] Inventor: Hermann Balk, Troisdorf, Fed. Rep. of Germany

[73] Assignee: Reifenhauser GmbH & Co. Maschinenfabrik, Troisdorf, Fed. Rep. of Germany

[21] Appl. No.: 55,466

[22] Filed: May 28, 1987

Related U.S. Application Data

[62] Division of Ser. No. 874,280, Jun. 13, 1986.

[30] Foreign Application Priority Data

Jun. 15, 1985 [DE] Fed. Rep. of Germany ..... 3521571

[51] Int. Cl.[4] ..... B29C 47/92

[52] U.S. Cl. ..... 425/140; 264/40.4; 264/40.7; 264/176.1; 425/141; 425/145; 425/376.1; 425/381; 425/467

[58] Field of Search ..... 425/135, 140, 141, 145, 425/146, 147, 376 A, 380, 381, 466, 467, 468; 264/12, 13, 40.1, 40.2, 40.4, 40.7, 176.1

[56] References Cited

U.S. PATENT DOCUMENTS

| | | | |
|---|---|---|---|
| 2,790,201 | 4/1957 | Eilbracht et al. | 264/13 |
| 3,110,930 | 11/1963 | Beck | 425/146 |
| 3,439,633 | 4/1969 | Pawlak et al. | 264/13 |
| 3,457,335 | 7/1969 | Elliott | 264/13 |
| 4,171,193 | 10/1979 | Rahlfs | 425/140 |
| 4,209,476 | 6/1980 | Harris | 425/145 |
| 4,420,441 | 12/1983 | Singer | 264/12 |

FOREIGN PATENT DOCUMENTS 60-234821 11/1985 Japan ..... 425/140

*Primary Examiner*—Jay H. Woo
*Assistant Examiner*—C. Scott Bushey
*Attorney, Agent, or Firm*—Herbert Dubno

[57] ABSTRACT

The process for making at least one thermoplastic monofilament of an exact diameter from a thermoplastic material by spinning in an apparatus in which a thermoplastic material is fed to at least one spinneret, which has at least one spinning plate with a plurality of spinning holes for the thermoplastic monofilaments, and forcing the thermoplastic material through the spinning holes with at least one spinning pump. To provide a monofilament of a very exact diameter the process further comprises measuring the diameter of each of the monofilaments in or after the outlet of the associated spinning hole, feeding the resulting measured value of this diameter as the actual value to a controller associated with that monofilament and controlling the flow rate of thermoplastic material through the associated spinning hole according to the difference between the actual value and a predetermined setpoint value. An apparatus for performing the above process according to my invention includes a spinneret, a spinning plate, at least one spinning pump, a plurality of spinning holes in the spinning plate as well as a device for measuring the diameter of each of the monofilaments and a mechanism for adjusting the flow rate of thermoplastic material including a movable stopper for each of the spinning holes and an associated adjusting motor.

1 Claim, 3 Drawing Sheets

APPARATUS FOR MAKING A THERMOPLASTIC MONOFILAMENT OF EXACT THICKNESS

This is a divisional of co-pending application Ser. No. 874,280 filed on June 13, 1986.

FIELD OF THE INVENTION

My present invention relates to an apparatus making a thermoplastic monofilament and, more particularly, to a process for making a thermoplastic monofilament of an exact thickness by spinning. It also relates to an apparatus including a spinneret.

BACKGROUND OF THE INVENTION

A known apparatus for making thermoplastic monofilaments by spinning has at least one spinneret suppliable with a thermoplastic material with at least one spinning plate and a plurality of spinning holes for the individual monofilaments. The thermoplastic material is forced through the spinning holes by at least one spinning pump. The express form of a spinning hole comprises a passage through the spinning plate.

In practice each spinning hole is a spinning passage in the spinning plate. Thus the spinning holes are a group of passages. The spinning plate has up to a hundred and twenty spinning passages. Generally a plurality of spinning pumps are provided which are controlled by a single controller or a single pump can feed a number of spinnerets. The diameter of the product monofilament is measured from time to time in a laboratory and the controller is used by an operator to change the value of the diameter of the output according to the measured diameter. Thus the control loop is completed by an operator and the laboratory technicians doing the measurement. In such a control process a considerable degree of subjective judgement goes into the measurements made by the individuals involved. Furthermore a considerable dead time occurs. The errors due to that and the variations in diameter of the monofilament are considerable.

OBJECTS OF THE INVENTION

It is an object of my invention to provide an improved apparatus for making a thermoplastic monofilament which avoids prior art drawbacks.

It is another object of my invention to provide an improved apparatus for making a thermoplastic monofilament in which a monofilament of a very exact diameter is produced.

It is also an object of my invention to provide an improved apparatus for making a thermoplastic monofilament which has a diameter which is more exactly equal to a preset diameter than has been possible previously, i.e. a monofilament of small diameter tolerance.

SUMMARY OF THE INVENTION

These objects and others which will become more readily apparent hereinafter are attained in a process for making at least one thermoplastic monofilament of an exact thickness by spinning comprises feeding a thermoplastic material to at least one spinneret, which has at least one spinning plate with a plurality of spinning holes for the thermoplastic monofilaments, and forcing the thermoplastic material through the spinning holes with at least one spinning pump.

The apparatus for making the thermoplastic monofilament comprises at least one spinneret supplied with a thermoplastic material which has at least one spinning plate with a plurality of spinning holes each for an individual monofilament, wherein the spinning holes are fed by at least one spinning pump.

According to my invention the process for making the thermoplastic monofilament comprises measuring the diameter of a monofilament in or after the outlet of the associated spinning hole, feeding the resulting measured value of this diameter as the actual value to a controller associated with that monofilament and controlling the flow rate of thermoplastic material through that associated spinning hole according to the difference between the actual value and a predetermined setpoint value.

This may be done in a variety of ways. In one particular embodiment which is characterized by a very high accuracy the individual spinning holes and thus the individual monofilaments are associated with separate controllers and/or control loops.

Another embodiment which is more economical in regard to apparatus expense is characterized by inputting the individual measurements of the monofilament diameters according to a predetermined or adjustable response sequence to one and the same controller and this controller controls the corresponding flow rates through the spinning holes according to a predetermined or adjustable control sequence. Here the response sequence or control sequence (thickness measuring scanning rate or cadence) is adjusted so that only very small thickness tolerances are permitted. Of course one operates with a control or scanning cadence which agrees with or coincides with the response cadence, i.e. the frequency with which the individual holes are controlled.

Naturally the thickness measurement can be performed in a variety of known ways. Suitable measuring devices exist, for example optical devices (see Firmendrucksache Dipl.-Ing. Bruno Richter GmbH & Co. "Einrichtung zur Durchmesserkontrolle einer Vielzahl von Kunststoff-Drähten, die in einem Fächer extrudiert werden", April 1980). It is also possible to measure the instantaneous temperature of a section of the monofilament directly below the spinning holes for a given time span and to convert this value to a thickness or diameter measurement. Also the quantity of thermoplastic material fed from the spinning pump or pumps or the pump speed can be measured and controlled within the scope of my invention. A plurality of spinning pumps connected parallel to each other can be used.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
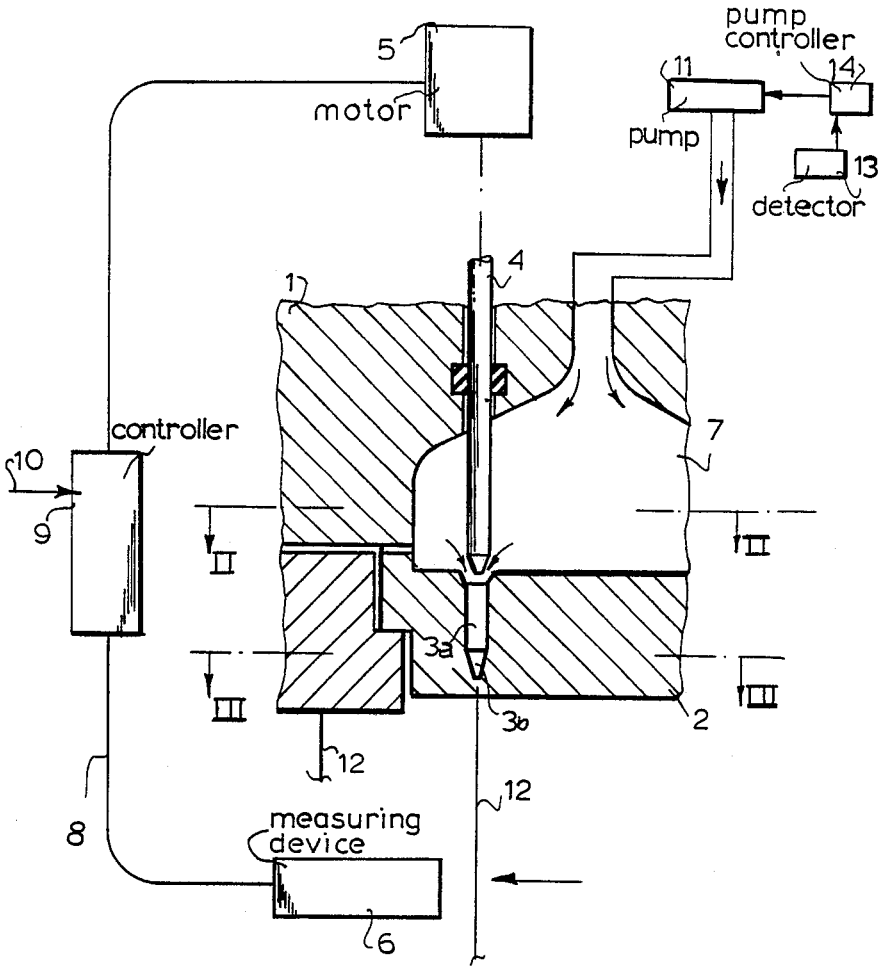
FIG. 1 is a schematic cross sectional view of a part of one embodiment of an apparatus for making a thermoplastic monofilament according to my invention for exact control of the thickness of the monofilament during its manufacture.
Figure 2:
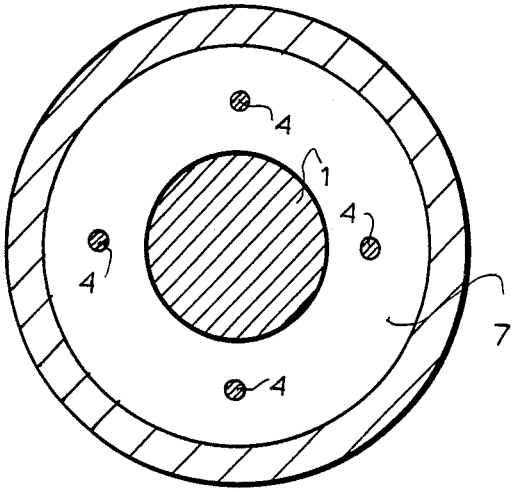
FIG. 2 is a cross sectional view of the apparatus of FIG. 1 taken along the section line II—II of FIG. 1.
Figure 3:
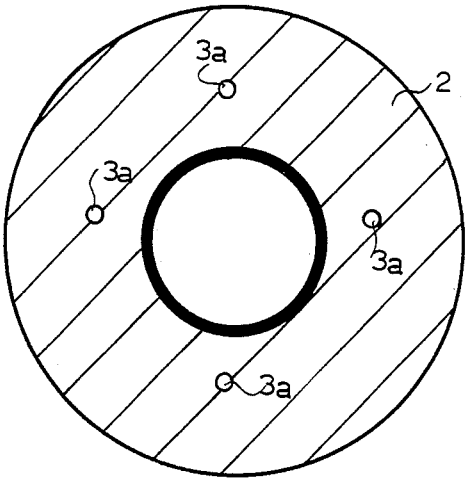
FIG. 3 is a cross sectional view of the apparatus of FIG. 1 taken along the section line III—III of FIG. 1.

FIGS. 1 to 3 show part of a nozzle or spinneret 1, which has an associated spinning plate 2. The spinning plate 2 has a plurality of spinning passages or spinning holes 3*a* through it. From the outlet 3*b* of each spinning hole 3*a* an individual monofilament 12 issues. The thermoplastic material is supplied by a spinning pump 11 to the spinning holes 3*a*.

FIG. 1 shows a mechanism for control of the flow rate of thermoplastic material to the spinning holes 3*a* in the drawing. It includes a movable stopper 4 and a positioning motor 5 which acts to move the stopper 4. FIG. 1 also shows a device 6 for measurement of the diameter of the individual monofilament 12 just below the outlet 3*b* of the associated spinning hole 3*a* which may operate by measuring either optical or thermal properties.

The spinning holes 3*a* are connected to a manifold 7 into which the thermoplastic material flows in the direction indicated by the flow arrows. The device 6 for measurement of the thickness of the monofilament 12 as well as the mechanism for control of the flow of the thermoplastic material are included in a control loop 8, which has a controller 9 which receives a set value of the diameter as indicated by the arrow 10. The device 6 for measurement of the diameter of an individual monofilament 12 supplies the actual value of the thickness of the monofilament 12. The controller 9 then acts on the positioning or servomotor 5 to correct the position of the movable stopper 4 to compensate for the difference between the set-point value and the actual value of the thickness of the monofilament 12.

The pumping speed of the pump 11 for the thermoplastic material can be advantageously monitored by a pump flow-rate detector 13 which communicates the measured value of pump speed to a pump controller 14 which acts to regulate the pump 11

Figure 4:
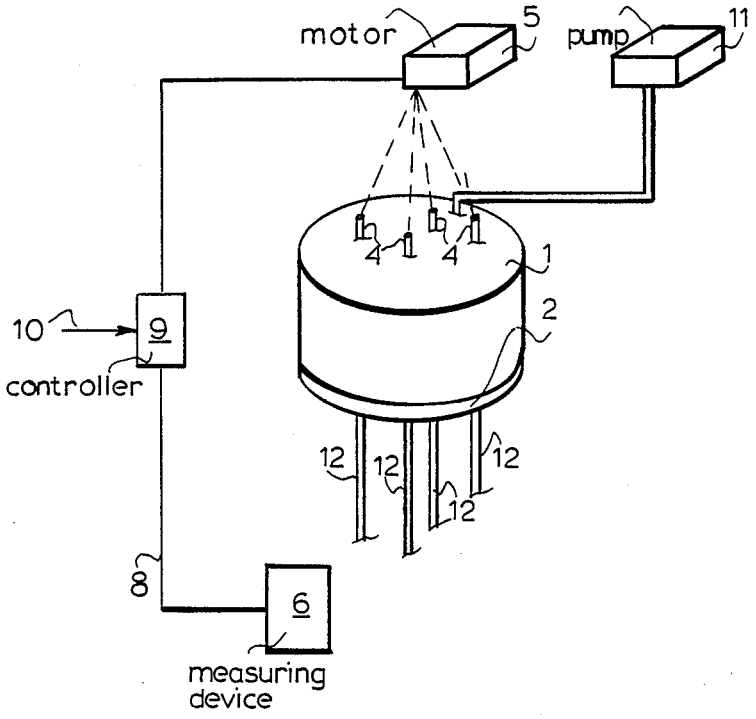
FIG. 4 is a perspective schematic view of an embodiment of an apparatus for making a plurality of thermoplastic monofilaments according to my invention.

FIG. 4 is a perspective view of an embodiment of the apparatus for making four thermoplastic monofilaments 12 according to my invention. It includes a control loop 8 with a controller 9 which receives the set-point value 10 of the diameter of the monofilaments 12. The diameter measuring device 6 measures the diameter of all the monofilaments 12 and the stoppers 4 are controlled by the single adjusting or servomotor 5 in the single control loop 8. A response cadence or frequency for successively obtaining the measured values of each of the monofilament diameters agreeing with a control cadence or frequency for controlling the flow rate at the individual spinning holes is used. Measurement and control signals may be multiplexed at this frequency if desired.

I claim:

1. An apparatus for making a plurality of thermoplastic monofilaments each of an exact diameter comprising:

a horizontal spinning plate having an array of spinning orifices;

a spinneret housing above said spinning plate and defining therewith a distribution chamber communication with all of said orifices for delivering a thermoplastic material to said orifices for the formation of individual thermoplastic monofilaments thereby;

at least one spinning pump for feeding said thermoplastic material to said chamber and communicating with said chamber through an opening formed in said housing centrally of said array of spinning orifices;

a respective rod-shaped movable stopper above said plate and formed with a valve head defining a variable flow passage at an upper edge of each of said orifices and regulating by up and down movement relative to said plate, a flow of the thermoplastic material through the respective orifice, said stoppers extending upwardly through said chamber and emerging from said housing at an opposite side of the chamber from said plate;

a respective positioning motor operatively connected to each of said stoppers at said opposite side of said chamber for moving said the respective stopper up and down to control said flow;

a respective device positioned for measurement of an actual value of the diameter of each individual one of said thermoplastic monofilaments and generating an actual value signal corresponding to the measured actual value;

a control circuit connected to each of said devices, receiving said actual value signal and provided with a setpoint input representing a desired diameter of said monofilaments for comparing the respective actual value with the setpoint value, said control circuit being connected to each positioning motor for shifting the respective stopper in response to the comparison of the respective actual value with said setpoint value.

* * * * *